US006331229B1

(12) United States Patent
Wong Shing et al.

(10) Patent No.: US 6,331,229 B1
(45) **Date of Patent: *Dec. 18, 2001**

(54) METHOD OF INCREASING RETENTION AND DRAINAGE IN PAPERMAKING USING HIGH MOLECULAR WEIGHT WATER-SOLUBLE ANIONIC OR MONIONIC DISPERSION POLYMERS

(75) Inventors: Jane B. Wong Shing, Aurora; Chidambaram Maltesh, Naperville; John R. Hurlock, Hickory Hills, all of IL (US)

(73) Assignee: Nalco Chemical Company, Naperville, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/392,671

(22) Filed: Sep. 8, 1999

(51) Int. Cl.[7] ..... D21H 11/00

(52) U.S. Cl. ..... 162/168.3; 162/183; 162/164.6; 162/168.3; 525/244

(58) Field of Search ..... 162/183, 164.1, 162/164.5, 164.6, 165, 168.1, 168.2, 168.3, 168.4, 181.1, 181.6, 181.8, 175; 525/244

(56) References Cited

U.S. PATENT DOCUMENTS

| | | | | |
|---|---|---|---|---|
| 5,605,970 | | 2/1997 | Selvarajan . | |
| 5,837,776 | * | 11/1998 | Selvarajan | 525/244 |
| 5,985,992 | | 11/1999 | Chen . | |
| 6,007,679 | * | 12/1999 | Nagarajan | 162/168.3 |

FOREIGN PATENT DOCUMENTS 0 183 466 A2 6/1986 (EP) .

* cited by examiner

*Primary Examiner*—Stanley S. Silverman
*Assistant Examiner*—M. Halpern
(74) *Attorney, Agent, or Firm*—Michael B. Martin; Thomas M. Breininge

(57) ABSTRACT

This invention is directed to a method of increasing retention and drainage in a papermaking furnish comprising adding to the furnish an effective flocculating amount of a high molecular weight water-soluble anionic or nonionic dispersion polymer.

16 Claims, No Drawings

METHOD OF INCREASING RETENTION AND DRAINAGE IN PAPERMAKING USING HIGH MOLECULAR WEIGHT WATER-SOLUBLE ANIONIC OR MONIONIC DISPERSION POLYMERS

TECHNICAL FIELD

This invention concerns a method of increasing retention and drainage in papermaking using high molecular weight water-soluble anionic or nonionic dispersion polymers.

BACKGROUND OF THE INVENTION

In the manufacture of paper, a papermaking furnish is formed into a paper sheet. The papermaking furnish is an aqueous slurry of cellulosic fiber having a fiber content of about 4 weight percent (percent dry weight of solids in the furnish) or less, and generally around 1.5% or less, and often below 1.0 % ahead of the paper machine, while the finished sheet typically has less than 6 weight percent water. Hence the dewatering and retention aspects of papermaking are extremely important to the efficiency and cost of the manufacture.

Gravity dewatering is the preferred method of drainage because of its relatively low cost. After gravity drainage more expensive methods are used for dewatering, for instance vacuum, pressing, felt blanket blotting and pressing, evaporation and the like. In actual practice a combination of such methods is employed to dewater, or dry, the sheet to the desired water content. Since gravity drainage is both the first dewatering method employed and the least expensive, an improvement in the efficiency of this drainage process will decrease the amount of water required to be removed by other methods and hence improve the overall efficiency of dewatering and reduce the cost thereof.

Another aspect of papermaking that is extremely important to the efficiency and cost is retention of furnish components on and within the fiber mat. The papermaking furnish represents a system containing significant amounts of small particles stabilized by colloidal forces. The papermaking furnish generally contains, in addition to cellulosic fibers, particles ranging in size from about 5 to about 1000 nm consisting of, for example, cellulosic fines, mineral fillers (employed to increase opacity, brightness and other paper characteristics) and other small particles that generally, without the inclusion of one or more retention aids, would in significant portion pass through the spaces (pores) between the mat formed by the cellulosic fibers on the papermachine.

Greater retention of fines, fillers, and other components of the furnish permits, for a given grade of paper, a reduction in the cellulosic fiber content of such paper. As pulps of lower quality are employed to reduce papermaking costs, the retention aspect of papermaking becomes more important because the fines content of such lower quality pulps is generally greater. Greater retention also decreases the amount of such substances lost to the whitewater and hence reduces the amount of material costs, the cost of waste disposal and the adverse environmental effects therefrom. It is generally desirable to reduce the amount of material employed in a papermaking process for a given purpose, without diminishing the result sought. Such add-on reductions may realize both a material cost savings and handling and processing benefits.

Another important characteristic of a given papermaking process is the formation of the paper sheet produced. Formation may be determined by the variance in light transmission within a paper sheet, and a high variance is indicative of poor formation. As retention increases to a high level, for instance a retention level of 80 or 90 %, the formation parameter generally declines.

Various chemical additives have been utilized in an attempt to increase the rate at which water drains from the formed sheet, and to increase the amount of fines and filler retained on the sheet. The use of high molecular weight water-soluble polymers is a significant improvement in the manufacture of paper. These high molecular weight polymers act as flocculants, forming large flocs which deposit on the sheet. They also aid in the dewatering of the sheet. In order to be effective, conventional single and dual polymer retention and drainage programs require incorporation of a higher molecular weight component as part of the program. In these conventional programs, the high molecular weight component is added after a high shear point in the stock flow system leading up to the headbox of the paper machine. This is necessary since flocs are formed primarily by a bridging mechanism and their breakdown is a largely irreversible process. For this reason, most of the retention and drainage performance of a flocculant is lost by feeding it before a high shear point. To their detriment, feeding high molecular weight polymers after the high shear point often leads to formation problems. The feed requirements of the high molecular weight polymers and copolymers which provide improved retention often lead to a compromise between retention and formation.

While successful, high molecular weight flocculant programs are improved by the addition of so called inorganic "microparticles". One such program employed to provide an improved combination of retention and dewatering is described in U.S. Pat. Nos. 4,753,710 and 4,913,775 incorporated herein by reference, in which a high molecular weight linear cationic polymer is added to the aqueous cellulosic papermaking suspension before shear is applied to the suspension, followed by the addition of bentonite after the shear application. Shearing is generally provided by one or more of the cleaning, mixing and pumping stages of the papermaking process, and the shear breaks down the large flocs formed by the high molecular weight polymer into microflocs. Further agglomeration then ensues with the addition of the bentonite clay particles.

Although, as described above, the microparticle is typically added to the furnish after the flocculant and after at least one shear zone, the microparticle effect can also be observed if the microparticle is added before the flocculant and the shear zone (U.S. Pat. No. 4,305,781).

Another program where an additive is injected prior to the flocculant is the so-called "enhancer/flocculant" treatment. Enhancer programs are comprised of the addition of an enhancer, such as phenolformaldehyde resin, to the furnish, followed by addition of a high molecular weight, nonionic flocculent such as polyethylene oxide (U.S. Pat. No. 4,070,236). In such systems, the enhancer improves the performance of the flocculant.

In a single polymer/microparticle retention and drainage aid program, a flocculant, typically a cationic polymer, is the only polymer material added along with the microparticle. Another method of improving the flocculation of cellulosic fines, mineral fillers and other furnish components on the fiber mat using a microparticle is in combination with a dual polymer program which uses, in addition to the microparticle, a coagulant and flocculant system. In such a system a coagulant is first added, for instance a low molecular weight synthetic cationic polymer or cationic starch. The coagulant may also be an inorganic coagulant such as alum or polyaluminum chlorides. This addition can take place at one or several points within the furnish make up system, including but not limited to the thick stock, white water system, or thin stock of a machine. This coagulant generally reduces the negative surface charges present on the particles in the furnish, such as cellulosic fines and mineral fillers, and thereby accomplishes a degree of agglomeration of such particles. However, in the presence of other detrimental anionic species, the coagulant serves to neutralize the interfering species enabling aggregation with the subsequent addition of a flocculant. Such a flocculant generally is a high molecular weight synthetic polymer which bridges the particles and/or agglomerates, from one surface to another, binding the particles into larger agglomerates. The presence of such large agglomerates in the furnish, as the fiber mat of the paper sheet is being formed, increases retention. The agglomerates are filtered out of the water onto the fiber web, whereas unagglomerated particles would, to a great extent, pass through such a paper web. In such a program the order of addition of the microparticle and flocculant can be reversed successfully.

However, there is continuing need to develop new retention aids to increase the efficiency of pulp or paper manufacture.

Commonly assigned U.S. Pat. Nos. 5,605,970 discloses a process for preparing certain high-molecular weight anionic polymer dispersions. Commonly assigned U.S. Pat. No. 5,837,776 discloses certain high molecular weight anionic flocculants and a process for their preparation. A process for the production of a water-soluble polymer dispersion in the presence of a dispersant, wherein the dispersant may be a poly(2-acrylamido-2-methyl propane sulfonic acid (AMPS)) or a copolymer having 30 or more mole percent of AMPS is disclosed in EP 0 183 466.

SUMMARY OF THE INVENTION

This invention is directed to a method of increasing retention and drainage in a papermaking furnish comprising adding to the furnish an effective flocculating amount of a high molecular weight water-soluble dispersion polymer wherein the dispersion polymer has a bulk Brookfield viscosity of from about 10 to about 25,000 cps at 25° C. and comprises from about 5 to about 50 weight percent of a water-soluble polymer prepared by polymerizing under free radical forming conditions in an aqueous solution of a water-soluble salt in the presence of a stabilizer:

i. 0–100 mole percent of at least one anionic monomer, and, ii. 100–0 mole percent of at least one non-ionic vinyl monomer;

wherein the stabilizer is an anionic water-soluble polymer having an intrinsic viscosity in 1M $NaNO_3$ of from about 0.1–10 dl/g and comprises from about 0.1 to about 5 weight percent based on the total weight of the dispersion, and the water-soluble salt is selected from the group consisting of ammonium, alkali metal and alkaline earth metal halides, sulfates, and phosphates and comprises from about 5 to about 40 weight percent based on the weight of the dispersion.

DETAILED DESCRIPTION OF THE INVENTION

"Monomer" means a polymerizable allylic, vinylic or acrylic compound.

"Anionic monomer" means a monomer as defined herein which possesses a net negative charge. Representative anionic monomers include acrylic acid, methacrylic acid, 2-acrylamido-2-methyl-1-propanesulfonic acid, acrylamidomethylbutanoic acid, maleic acid, fumaric acid, itaconic acid, vinyl sulfonic acid, styrene sulfonic acid, vinyl phosphonic acid, allyl sulfonic acid, allyl phosphonic acid, sulfomethylated acrylamide, phosphonomethylated acrylamide and the water-soluble alkali metal, alkaline earth metal, and ammonium salts thereof. The choice of anionic monomer is based upon several factors including the ability of the monomer to polymerize with the desired comonomer, the use of the produced polymer, and cost. A preferred anionic monomer is acrylic acid.

In certain instances, it may be possible to chemically modify a non-ionic monomer component contained in the dispersion polymer of the invention after polymerization to obtain an anionic functional group, for example, the modification of an incorporated acrylamide mer unit to the corresponding sulfonate or phosphonate.

"Nonionic monomer" means a monomer as defined herein which is electrically neutral. Representative nonionic monomers include acrylamide, methacrylamide, N-methylacrylamide, N-isopropylacrylamide, N-t-butyl acrylamide, N-methylolacrylamide, N, N-dimethyl(meth) acrylamide, N-isopropyl(meth)acrylamide, N-(2-hydroxypropyl)methacrylamide, N-methylolacrylamide, N-vinylformamide, N-vinylacetamide, N-vinyl-N-methylacetamide, poly(ethylene glycol)(meth)acrylate, poly (ethylene glycol) monomethyl ether mono(meth)acryate, N-vinyl-2-pyrrolidone, glycerol mono((meth)acrylate), 2-hydroxyethyl(meth)acrylate, vinyl methylsulfone, vinyl acetate, and the like. Preferred nonionic monomers of include acrylamide, methacrylamide, N-isopropylacrylamide, N-t-butyl acrylamide, and N-methylolacrylamide. More preferred nonionic monomers include acrylamide and methacrylamide. Acrylamide is still more preferred.

RSV stands for Reduced Specific Viscosity. Reduced Specific Viscosity is an indication of polymer chain length and average molecular weight. Polymer chain length and average molecular weight are indicative of the extent of polymerization during production. The RSV is measured at a given polymer concentration and temperature and calculated as follows:

$$RSV = \frac{[(\eta/\eta_0) - 1]}{c}$$

$\eta$=viscosity of polymer solution $\eta_o$ =viscosity of solvent at the same temperature c=concentration of polymer in solution.

In this patent application, the units of concentration "c" are (grams/100 ml or g/deciliter). Therefore, the units of RSV are dl/g. In this patent application, for measuring RSV, the solvent used is 1.0 Molar sodium nitrate solution. The polymer concentration in this solvent is 0.045 g/dl. The RSV is measured at 30° C. The viscosities $\eta$ and $\eta_o$ were measured using a Cannon Ubbelohde semimicro dilution viscometer, size 75. The viscometer is mounted in a perfectly vertical position in a constant temperature bath adjusted to 30±0.02° C. The error inherent in the calculation of RSV is about 2 dl/grams. When two polymers of the same composition have similar RSV's measured under identical conditions that is an indication that they have similar molecular weights.

IV stands for intrinsic viscosity, which is RSV when the limit of polymer concentration is zero.

"Inverse emulsion polymer" and "latex polymer" mean a self-inverting water in oil polymer emulsion comprising a polymer according to this invention in the aqueous phase, a hydrocarbon oil for the oil phase, a water-in-oil emulsifying agent and an inverting surfactant. Inverse emulsion polymers are hydrocarbon continuous with the water-soluble polymers dispersed as micron sized particles within the hydrocarbon matrix. The inverse emulsion polymers are then "inverted" or activated for use by releasing the polymer from the particles using shear, dilution, and, generally, another surfactant.

Inverse emulsion polymers are prepared by dissolving the required monomers in the water phase, dissolving the emulsifying agent in the oil phase, emulsifying the water phase in the oil phase to prepare a water-in-oil emulsion, homogenizing the water-in-oil emulsion, polymerizing the monomers dissolved in the water phase of the water-in-oil emulsion to obtain the polymer and then adding the self-inverting surfactant to obtain the water-in-oil self-inverting water-in-oil emulsion.

"Dispersion polymer" means a water-soluble polymer dispersed in an aqueous continuous phase containing one or more inorganic salts. In the process of dispersion polymerization, the monomer and the initiator are both soluble in the polymerization medium, but the medium is a poor solvent for the resulting polymer. Accordingly, the reaction mixture is homogeneous at the onset, and the polymerization is initiated in a homogeneous solution. Depending on the solvency of the medium for the resulting oligomers or macroradicals and macromolecules, phase separation occurs at an early stage. This leads to nucleation and the formation of primary particles called "precursors" and the precursors are colloidally stabilized by adsorption of stabilizers. The particles are believed to be swollen by the polymerization medium and/or the monomer, leading to the formation of spherical particles having a size in the region of ~0.1–10.0 microns.

"Anionic dispersion polymer" means a dispersion polymer as defined herein which possesses a net negative charge.

"Nonionic dispersion polymer" means a dispersion polymer as defined herein which is electrically neutral.

In any dispersion polymerization, the variables that are usually controlled are the concentrations of the stabilizer, the monomer and the initiator, solvency of the dispersion medium, and the reaction temperature. It has been found that these variables can have a significant effect on the particle size, the molecular weight of the final polymer particles, and the kinetics of the polymerization process.

Particles produced by dispersion polymerization in the absence of any stabilizer are not sufficiently stable and may coagulate after their formation. Addition of a small percentage of a suitable stabilizer to the polymerization mixture produces stable dispersion particles. Particle stabilization in dispersion polymerization is usually referred to as "steric stabilization". Good stabilizers for dispersion polymerization are polymer or oligomer compounds with low solubility in the polymerization medium and moderate affinity for the polymer particles.

As the stabilizer concentration is increased, the particle size decreases, which implies that the number of nuclei formed increases with increasing stabilizer concentration. The coagulation nucleation theory very well accounts for the observed dependence of the particle size on stabilizer concentration, since the greater the concentration of the stabilizer adsorbed the slower will be the coagulation step. This results in more precursors becoming mature particles, thus reducing the size of particles produced.

As the solvency of the dispersion medium increases, (a) the oligomers will grow to a larger MW before they become a precursor nuclei, (b) the anchoring of the stabilizer moiety will probably be reduced and (c) the particle size increases. As the initiator concentration is increased, it has been observed that the final particle size increases. As for the kinetics, it is reported that when the dispersion medium is a non-solvent for the polymer being formed, then the locus of polymerization is largely within the growing particles and the system follows the bulk polymerization kinetics, n (the kinetic chain length)=$R_p/R_t$, where $R_p$ is the propagation rate and $R_t$ is the termination rate. As the solvency of the dispersion medium for the growing polymer particle is increased, polymer growth proceeds in solution. The polymeric radicals that are formed in solution are then captured by growing particles. Consequently, the locus of the particle polymerization process changes and there is a concomitant change in the kinetics of polymerization.

The dispersion polymers of the instant invention contain from about 0.1 to about 5 weight percent based on the total weight of the dispersion of a stabilizer.

Stablizers as used herein include anionically charged water-soluble polymers having a molecular weight of from about 100,000 to about 5,000,000 and preferably from about 1,000,000 to about 3,000,000. The stabilizer polymer must be soluble or slightly soluble in the salt solution, and must be soluble in water. The stabilizer polymers generally have an intrinsic viscosity in 1M $NaNO_3$ of from about 0.1–10 dl/g, preferably from about 0.5–7.0 dl/g and more preferably from about 2.0–6.0 dl/g at 30° C.

Preferred stabilizers are polyacrylic acid, poly(meth) acrylic acid, poly(2-acrylamido-2-methyl-1-propanesulfonic acid) and copolymers of 2-acrylamido-2-methyl-1-propanesulfonic acid and an anionic comonomer selected from acrylic acid and methacrylic acid.

The stabilizer polymers are prepared using conventional solution polymerization techniques, are prepared in water-in-oil emulsion form or are prepared in accordance with the dispersion polymerization techniques described herein. The choice of a particular stabilizer polymer will be based upon the particular polymer being produced, the particular salts contains in the salt solution, and the other reaction conditions to which the dispersion is subjected during the formation of the polymer.

Preferably from about 0.1 to about 5 percent by weight, more preferably from about 0.25 to about 1.5 percent and still more preferably, from about 0.4 to about 1.25 percent by weight of stabilizer, based on the weight of the total dispersion or finished product, is utilized.

Polymer dispersions prepared in the absence of the stabilizer component result in paste like slurries indicating that a stable dispersion did not form. The paste like products generally thickened within a relatively short period of time into a mass that could not be pumped or handled within the general applications in which polymers of this type are employed.

The remainder of the dispersion consists of an aqueous solution comprising from about 2 to about 40 weight percent based on the total weight of the dispersion of a water-soluble salt selected from the group consisting of ammonium, alkali metal and alkaline earth metal halides, sulfates, and phosphates.

The salt is important in that the polymer produced in such aqueous media will be rendered insoluble on formation, and polymerization will accordingly produce particles of water-soluble polymer when suitable agitation is provided. The selection of the particular salt to be utilized is dependent upon the particular polymer to be produced, and the stabilizer to be employed. The selection of salt, and the amount of salt present should be made such that the polymer being produced will be insoluble in the salt solution. Particularly useful salts include a mixture of ammonium sulfate and sodium sulfate in such quantity to saturate the aqueous solution. While sodium sulfate may be utilized alone, we have found that it alters the precipitation process during polymerization. Salts containing di- or trivalent anions are preferred because of their reduced solubility in water as compared to for example alkali, alkaline earth, or ammonium halide salts, although monovalent anion salts may be employed in certain circumstances. The use of salts containing di- or trivalent anions generally results in polymer dispersions having lower percentages of salt materials as compared to salts containing monovalent anions.

The particular salt to be utilized is determined by preparing a saturated solution of the salt or salts, and determining the solubility of the desired stabilizer and the desired polymer. Preferably from about 5 to about 30, more preferably from about 5 to about 25 and still more preferably from about 8 to about 20 weight percent based on the weight of the dispersion of the salt is utilized. When using higher quantities of monomer less salt will be required.

In addition to the above, other ingredients may be employed in making the polymer dispersions of the present invention. These additional ingredients may include chelating agents designed to remove metallic impurities from interfering with the activity of the free radical catalyst employed, chain transfer agents to regulate molecular weight, nucleating agents, and codispersant materials. Nucleating agents when utilized generally encompass a small amount of the same polymer to be produced. Thus if a polymer containing 70 mole percent acrylic acid (or its water-soluble salts) and 30 percent acrylamide are to be produced, a nucleating agent or "seed" of the same or similar polymer composition may be utilized. Generally up to about 10 weight percent, preferably about 0.1 to about 5, more preferably from about 0.5 to about 4 and still more preferably from about 0.75 to about 2 weight percent of a nucleating agent is used based on the polymer contains in the dispersion is utilized.

Codispersant materials to be utilized include dispersants from the classes consisting of water-soluble sugars, polyethylene glycols having a molecular weight of from about 2000 to about 50,000, and other polyhydric alcohol type materials. Amines and polyamines having from 2–12 carbon atoms are often times also useful as codispersant materials, but, must be used with caution because they may also act as chain transfer agents during polymerization. The function of a codispersant is to act as a colloidal stabilizer during the early stages of polymerization. The use of codispersant materials is optional, and not required to obtain the polymer dispersions of the invention. When utilized, the codispersant is present at a level of up to about 10, preferably from about 0.1–4 and more preferably from about 0.2–2 weight percent based on the dispersion.

The total amount of water-soluble polymer prepared from the anionic and the nonionic water-soluble monomers in the dispersion may vary from about 5 to about 50 percent by weight of the total weight of the dispersion, and preferably from about 10 to about 40 percent by weight of the dispersion. Most preferably the dispersion contains from about 15 to about 30 percent by weight of the polymer prepared from the nonionic and anionic water-soluble monomers.

Polymerization reactions described herein are initiated by any means which results in generation of a suitable free-radical. Thermally derived radicals, in which the radical species results from thermal, homolytic dissociation of an azo, peroxide, hydroperoxide and perester compound are preferred. Especially preferred initiators are azo compounds including 2,2'-azobis(2-amidinopropane) dihydrochloride, 2,2'-azobis[2-(2-imidazolin-2-yl)propane] dihydrochloride, 2,2'-azobis(isobutyronitrile) (AIBN), 2,2'-azobis(2,4-dimethylvaleronitrile) (AIVN), and the like.

The monomers may be mixed together with the water, salt and stabilizer prior to polymerization, or alternatively, one or both monomers may be added stepwise during polymerization in order to obtain proper incorporation of the monomers into the resultant dispersion polymer. Polymerizations of this invention may be run at temperatures ranging from −10° C. to as high as the boiling point of the monomers employed. Preferably, the dispersion polymerization is conducted at from −10° C. to about 80° C. More preferably, polymerization is conducted at from about 30° C. to about 45° C.

The dispersion polymers of this invention are prepared at a pH of about 3 to about 8. After polymerization the pH of the dispersion may be adjusted to any desired value as long as the polymer remains insoluble to maintain the dispersed nature. Preferably, polymerization is conducted under inert atmosphere with sufficient agitation to maintain the dispersion.

The dispersion polymers of the instant invention typically have bulk solution viscosities of less than about 25,000 cps at 25° C. (Brookfield), more preferably less than 5,000 cps and still more preferably less than about 2,000 cps. At these viscosities, the polymer dispersions are easily handled in conventional polymerization equipment.

The dispersion polymers of this invention typically have molecular weights ranging from about 50,000 up to the aqueous solubility limit of the polymer. Preferably, the dispersions have a molecular weight of from about 1,000,000 to about 50 million.

In a preferred aspect of this invention, the stabilizer has a concentration from about 0.25 to about 2 weight percent based on the weight of the total dispersion and an intrinsic viscosity in 1M $NaNO_3$ of from about 0.5–7.0 dl/g.

In another preferred aspect of this invention, the stabilizer is polyacrylic acid; poly(2-acrylamido-2-methyl-1-propanesulfonic acid); an anionic water-soluble copolymer formed by free radical polymerization of 2-acrylamido-2-methyl- 1-propanesulfonic acid with acrylic acid, wherein the copolymer comprises from about 3 to about 60 weight percent 2-acrylamido-2-methyl-1-propanesulfonic acid and from about 97 to about 40 weight percent acrylic acid; or an anionic water-soluble copolymer formed by free radical polymerization of 2-acrylamido-2-methyl-1-propanesulfonic acid with methacrylic acid, wherein the copolymer comprises from about 11 to about 95.5 weight percent 2-acrylamido-2-methyl-1-propanesulfonic acid and from about 89 to about 4.5 weight percent methacrylic acid.

In a more preferred aspect of this invention, the water-soluble polymer is poly (acrylic acid/acrylamide) having a weight ratio of 7:93 for acrylic acid to acrylamide and the stabilizer is poly (2-acrylamido-2-methyl-1-propanesulfonic acid/acrylic acid) having a weight ratio of 13:87 2-acrylamido-2-methyl- 1-propanesulfonic acid: acrylic acid.

In another more preferred aspect of this invention, the water-soluble polymer is poly (acrylic acid/acrylamide) having a weight ratio of 7:93 for acrylic acid to acrylamide and the stabilizer is poly (2-acrylamido-2-methyl-1-propanesulfonic acid/acrylic acid) having a weight ratio of 51:49 2-acrylamido-2-methyl- 1-propanesulfonic acid: methacrylic acid.

In another more preferred aspect of this invention, the water-soluble polymer is poly (acrylic acid/acrylamide) having a weight ratio of 30:70 for acrylic acid to acrylamide and the stabilizer is poly (2-acrylamido-2-methyl-1-propanesulfonic acid/methacrylic acid) having a weight ratio of 84.7:15.3 2-acrylamido-2-methyl-1-propanesulfonic acid: methacrylic acid.

In a more preferred aspect of this invention, the water-soluble polymer is poly (acrylic acid/acrylamide) having a weight ratio of 30:70 for acrylic acid to acrylamide and the stabilizer is poly (2-acrylamido-2-methyl-1-propanesulfonic acid/methacrylic acid) having a weight ratio of 90.6:9.4 2-acrylamido-2-methyl-1-propanesulfonic acid: methacrylic acid.

In another more preferred aspect of this invention, from about 0.02 lbs polymer/ton to about 20 lbs polymer/ton, preferably from about 1 lbs polymer/ton to about 15 lbs polymer/ton and more preferably, from about 1 lbs polymer/ton to about 4 lbs polymer/ton of the the high molecular weight water-soluble dispersion polymer is added to the papermaking furnish.

"Pounds polymer/ton" means pounds of actual polymer per 2000 pounds of solids present in slurry. The abbreviation for pounds of actual polymer per 2000 pounds of solids present in slurry is "lbs polymer/ton".

In another more preferred aspect of this invention, a microparticle is added to the pulp.

"Microparticles" means highly charged materials that improve flocculation when used together with natural and synthetic macromolecules. They constitute a class of retention and drainage chemicals defined primarily by their submicron size. A three dimensional structure, an ionic surface, and a submicron size are the general requirements for effective microparticles. "Microparticles" encompass a broad set of chemistries including polysilicate microgel, structured silicas, colloidal alumina, polymers, and the like.

Microparticle programs enhance the performance of current retention programs and optimize wet end chemistry, paper quality and paper machine efficiency. Microparticles are not designed to be used as a sole treatment. Rather, they are used in combination with other wet end additives to, improve retention and drainage on the paper machine. Commonly used microparticles include:

i) copolymers of acrylic acid and acrylamide;

ii) bentonite and other clays;

iii) dispersed silica based materials; and iv) naphthalene sulfonate/formaldehyde condensate polymers.

Copolymers of acrylic acid and acrylamide useful as microparticles include: a representative copolymer of acrylic acid and acrylamide is Nalco® 8677 PLUS, available from Nalco Chemical Company, Naperville, Ill., U.S.A. Other copolymers of acrylic acid and acrylamide are described in U.S. Pat. No. 5,098,520, incorporated herein by reference.

Bentonites useful as the microparticle for this process include: any of the materials commercially referred to as bentonites or as bentonite-type clays, i.e., anionic swelling clays such as sepialite, attapulgite and montmorillonite. In addition, bentonites described in U.S. Pat. No. 4,305,781 are suitable. A preferred bentonite is a hydrated suspension of powdered bentonite in water. Powdered bentonite is available as Nalbrite™, from Nalco Chemical Company.

Representative dispersed silicas have an average particle size of from about 1 to about 100 nanometers (nm), preferably from about 2 to about 25 nm, and more preferably from about 2 to about 15 nm. This dispersed silica, may be in the form of colloidal, silicic acid, silica sols, fumed silica, agglomerated silicic acid, silica gels, precipitated silicas, and all materials described in Patent Cooperation Treaty Patent Application No. PCT/US98/19339, so long as the particle size or ultimate particle size is within the above ranges. Dispersed silica in water with a typical particle size of 4 nm is available as Nalco® 8671, from Nalco Chemical Company. Another type of dispersed silica, is a borosilicate in water; available as Nalco® 8692, from Nalco Chemical Company.

Representative naphthalene sulfonate/formaldehyde condensate polymers useful as microparticles are available as Nalco® 8678 from Nalco Chemical Company.

The amount of microparticle added is from about 0.05 to about 5.0, preferably from about 1.5 to about 4.5 and more preferably about 2 to about 4.5 pounds microparticle/ton.

"Pounds microparticle/ton" means pounds of actual microparticle per 2000 pounds of solids present in slurry. The abbreviation for pounds of actual microparticle per 2000 pounds of solids present in slurry is "lbs microparticle/ton".

The microparticle is added to the papermaking furnish either before or after the dispersion polymer is added to the furnish. The choice of whether to add the microparticle before or after the polymer can be made by a person of ordinary skill in the art based on the requirements and specifications of the papermaking furnish.

In another preferred aspect of this invention, a coagulant is added to the furnish prior to the addition of the anionic or nonionic dispersion polymer.

In another preferred aspect, the coagulant is a water-soluble cationic polymer.

In another preferred aspect, the water-soluble cationic polymer is epichlorohydrindimethylamine or polydiallyldimethylammonium chloride.

In another preferred aspect, the coagulant is selected from alum or polyaluminum chlorides.

In another preferred aspect, the coagulant is a cationic starch.

The foregoing may be better understood by reference to the following examples, which are presented solely for illustration. Changes can be made in the composition, operation and arrangement of this invention without departing from the concept and scope of the invention as defined in the claims.

Preparation of AA/AMPS and MAA/AMPS Copolymer Stabilizers

EXAMPLE 1

To a 1.5-liter resin reactor equipped with stirrer, temperature controller, and water cooled condenser is added 906.79 g of deionized water, 200 g of acrylic acid, 220.34 g of a 50% solution of sodium hydroxide (pH=7.0) and 0.20 g of EDTA. The resulting solution is sparged with 1000 cc/min. of nitrogen, heated to 45° C. and 1.00 g of a 12% solution of sodium bisulfite and 5.00 g of a 10% solution of 2,2' azobis(N,N'2-amidinopropane) dihydrochloride (V-50, available from Wako Chemicals U.S.A., Inc., Richmond, Va., U.S.A.) are added. Polymerization begins within 5 minutes and after 20 minutes, the solution became viscous and the temperature of the reaction rises to 80° C. The reaction is continued for a total of 16 hours at 78–82° C. The resulting polymer has a Brookfield viscosity of 60000 cps at 25° C. and contains 15% of a homopolymer of acrylic acid with an intrinsic viscosity of 2.08 dl/gm in 1.0 molar $NaNO_3$.

EXAMPLE 2

To a 1.5-liter resin reactor equipped with stirrer, temperature controller and water cooled condenser is added 910.75 g of deionized water, 49.45 g of a 58% solution of the sodium salt of2-acrylamido-2-methyl-1-propanesulfonic acid (AMPS), 171.32 g of acrylic acid, 187.17 g of a 50% solution of sodium hydroxide (pH=7.0) and 0.20 g of EDTA. The resulting solution is sparged with 1000 cc/min. of nitrogen, heated to 45° C. and 1.00 g of a 25% solution of sodium bisulfite and 5.00 g of a 10% solution of V-50 are added. Polymerization begins within 5 minutes and after 15 minutes, the solution becomes viscous and the temperature of the reaction rises to 80° C. The reaction is continued for a total of 16 hours at 78–82° C. The resulting polymer solution has a Brookfield viscosity of 15100 cps at 25° C. and contains 15% of a 87/13 w/w copolymer of acrylic acid/AMPS with an intrinsic viscosity of 1.95 dl/gm in 1.0 molar $NaNO_3$.

The properties of the AA, AMPS and AA/AMPS stabilizers prepared in Examples 1–8 are summarized in Table 1. Stabilizers 3–7 are prepared as described in Example 2. Stabilizer 8 is prepared as described in U.S. Pat. No. 5,837,776.

TABLE 1

AA and AA/AMPS Copolymer Stabilizers

| Example | Stabilizer AA/AMPS wt/wt | Stabilizer AA/AMPS mol/mol | IV dl/gm | VISC Cp. |
|---|---|---|---|---|
| 1 | 100/0 | 100/0 | 2.08 | 60000 |
| 2 | 87/13 | 95.0/5.0 | 1.95 | 15100 |
| 3 | 97/3 | 98.75/1.25 | 2.19 | 56000 |
| 4 | 93/7 | 97.5/2.5 | 2.44 | 69500 |
| 5 | 77/23 | 90.7/9.3 | 2.49 | 61000 |
| 6 | 60/40 | 80/20 | 2.35 | 12500 |
| 7 | 40/60 | 66/37 | 2.79 | 1000 |
| 8 | 0/100 | 0/100 | 3.73 | |

EXAMPLE 9

To a 1.5-liter resin reactor equipped with stirrer, temperature controller and water cooled condenser is added 945.59 g of deionized water, 141.96 g of a 58% solution of the sodium salt of 2-acrylamido-2-methyl-1-propanesulfonic acid (AMPS), 126.18 g of 99% methacrylic acid, 114.9 g of a 50% solution of sodium hydroxide (pH=7.0) and 0.20 g of EDTA. The resulting solution is sparged with 1000 cc/min. of nitrogen, heated to 45° C. and 0.50 g of V-50 is added. Polymerization began within 15 minutes and after 60 minutes, the solution becomes viscous and the temperature of the reaction rises to 50° C. The reaction is continued for a total of 72 hours at 48–52° C. The resulting polymer solution has a Brookfield viscosity of 61300 cps at 25° C. and contains 15% of a 62.5/37.5 w/w (80/20 M/M) copolymer of methacrylic acid/AMPS with an intrinsic viscosity of 4.26 dl/gm in 1.0 molar $NaNO_3$.

EXAMPLE 10

To a 1.5-liter resin reactor equipped with stirrer, temperature controller and water cooled condenser is added 939.21 g of deionized water, 191.92 g of a 58% solution of the sodium salt of 2-acrylamido-2-methyl-1-propanesulfonic acid (AMPS), 99.5 g of 99% methacrylic acid, 92.0 g of a 50% solution of sodium hydroxide (pH=7.0) and 0.20 g of EDTA. The resulting solution is sparged with 1000 cc/min. of nitrogen, heated to 45° C. and 0.50 g of V-50 is added. Polymerization begins within 15 minutes and after 60 minutes, the solution becomes viscous and the temperature of the reaction rises to 50° C. The reaction is continued for 18 hours at 48–52° C. The reaction mixture is than heated to 80° C. and maintained at 78–82° C. for 24 hours. The resulting polymer solution has a Brookfield viscosity of 43200 cps at 25° C. and contains 15% of a 49/51 w/w (70/30 M/M) copolymer of methacrylic acid/AMPS with an intrinsic viscosity of 4.28 dl/gm in 1.0 molar $NaNO_3$.

The properties of the MAA/AMPS stabilizers prepared in Examples 9–19 are summarized in Table 2. Stabilizers 11–19 are prepared as described in Examples 9 and 10.

TABLE 2

MAA/AMPS Copolymer Stabilizers.

| Example | Polymer MAA/AMPS wt/wt | Polymer MAA/AMPS mol/mol | IV dl/gm | VISC cp. |
|---|---|---|---|---|
| 9 | 62.5/37.5 | 80/20 | 4.26 | 61300 |
| 10 | 49/51 | 70/30 | 4.28 | 43200 |
| 11 | 79/21 | 90/10 | 3.07 | 24375 |
| 12 | 89/11 | 95/05 | 3.55 | 37000 |
| 13 | 38.4/61.6 | 60/40 | 3.59 | 32500 |
| 14 | 29.4/70.6 | 50/50 | 3.63 | 31750 |
| 15 | 29.4/70.6 | 50/50 | 3.10 | 15100 |
| 16 | 21.7/78.3 | 40/60 | 2.88 | 9420 |
| 17 | 15.3/84.7 | 30/70 | 2.54 | 6470 |
| 18 | 9.4/90.6 | 20/80 | 2.53 | 8150 |
| 19 | 4.5/95.5 | 10/90 | 2.38 | 41000 |

Preparation of the Anionic Dispersion Polymers

EXAMPLE 20

To a 1.5liter resin reactor equipped with stirrer, temperature controller and water cooled condenser is added 442.44 g of deionized water, 126 g of sodium sulfate, 84 g of ammonium sulfate, 0.40 g of sodium formate, 40 g of a 15% solution of an 87/13 w/w copolymer of acrylic acid/AMPS, 280.99 g of a 49.6% solution of acrylamide (139.36 g), 10.64 g of acrylic acid, 11.65 g of 50% aqueous sodium hydroxide, 0.40 g of sodium formate and 0.25 g of EDTA. The mixture is heated to 35° C. and 0.30 g of a 4% solution of 2,2' azobis(N,N'-dimethylene isobutryramidine) dihydrochloride (VA-044, available from Wako Pure Chemical Industries Ltd, Osaka, Japan) is added. The resulting solution is sparged with 1000 cc/min. of nitrogen. After 30 minutes, polymerization begins and the solution becomes viscous. After 2 hours, the mixture is a milky dispersion and 0.30 g of a 4% solution of VA-044 is added. After 4 hours, 0.30 g of a 4% solution of VA-044 is added. After 5 hours, 1.20 g of a 4% solution of VA-044 is added. After 8 hours, 2.90 g of a 4% solution of VA-044 is added. The reaction is continued for a total of 16 hours at 34–36° C. The resulting polymer dispersion has a Brookfield viscosity of 2950 cps. To the resulting dispersion polymer is added 6 g of sodium sulfate and 4 g of ammonium sulfate. The resulting polymer dispersion has a Brookfield viscosity of 1200 cps, a pH of 7.0, and contains 15% of a 93/7 copolymer of acrylamide/acrylic acid with a reduced specific viscosity of 23.1 dl/gm at 0.045% in 1.0 N $NaNO_3$.

EXAMPLE 21

To a 1.5-liter resin reactor equipped with stirrer, temperature controller and water cooled condenser is added 443.42 g of deionized water, 126 g of sodium sulfate, 84 g of ammonium sulfate, 0.40 g of sodium formate, 40 g of a 15% solution of a 62.5/37.5 w/w copolymer of methacrylic acid/AMPS, 280.99 g of a 49.6% solution of acrylamide (139.36 g), 10.64 g of acrylic acid, 11.8 g of 50% aqueous sodium hydroxide and 0.25 g of EDTA. The mixture is heated to 35° C. and 0.30 g of a 1% solution of VA-044 is added. The resulting solution is sparged with 1000 cc/min. of nitrogen. After 30 minutes, polymerization begins and the solution becomes viscous. After 2 hours, the mixture is a milky dispersion and 0.30 g of a 1% solution of VA-044 is added. After 4 hours, 0.30 g of a 1% solution of VA-044 is added. After 5 hours, 1.2 g of a 1% solution of VA-044 is added. After 6 hours, 2.9 g of a 1% solution of VA-044 is added. After 7 hours, 5.0 g of a 1% solution of VA-044 is added. The reaction is continued for a total of 16 hours at 34–36° C. To the resulting dispersion polymer is added 6 g of sodium sulfate and 4 g of ammonium sulfate. The resulting polymer dispersion has a Brookfield viscosity of 825 cps ,a pH of 7.0, and contains 15% of a 93/7 copolymer of acrylamide/acrylic acid with a reduced specific viscosity of 22.9 dl/gm at 0.045% in 1.0 N $NaNO_3$.

EXAMPLE 22

To a 1.5-liter resin reactor equipped with stirrer, temperature controller and water cooled condenser is added 535.81 g of deionized water, 71.27 g of sodium sulfate, 92.78 g of ammonium sulfate, 0.80 g of sodium formate, 40 g of a 15% solution of a 29.4/70.6 w/w copolymer of methacrylic acid/AMPS, 210.81 g of a 49.6% solution of acrylamide (104.56 g), 45.44 g of acrylic acid, 1.50 g of 50% sodium hydroxide and 0.25 g of EDTA. The mixture is heated to 35° C. and 1.0 g of a 2% solution of VA-044 is added. The resulting solution is sparged with 1000 cc/min. of nitrogen. After 1.5 hours, the mixture is a milky dispersion. After 4 hours, 1.0 g of a 2% solution of VA-044 is added. After 7 hours, 3.0 g of a 2% solution of VA-044 is added. The reaction is continued for a total of 27 hours at 34–36° C. The resulting polymer dispersion has a Brookfield viscosity of 10000 cps , a pH of 3.62, and contained 15% of a 70/30 copolymer of acrylamide/acrylic acid with a reduced specific viscosity of 18.78 dl/gm at 0.045% in 1.0 N $NaNO_3$.

The properties of representative anionic polymer dispersions are listed in Table 3. In Table 3, Polymer I is prepared as described in Example 20, Polymers II, III and IV are prepared as described in Example 21 and Polymers V, VI, VII VIII, IX, X and XI are prepared as described in Example 22 using the appropriate stabilizer.

TABLE 3

Anionic Dispersion Polymers with AA/AMPS and MAA/AMPS Stabilizers.

| Polymer Description | | | | | | |
|---|---|---|---|---|---|---|
| | | | Formate | | Stabilizer | |
| | AcAm/AA (Wt. %) | RSV, dl/g | Level, ppm | Actives, % | Chemistry (Wt. %) | IV, dl/g |
| I | 93/7 | 23.1 | 400 | 15 | AA/AMPS 87/13 | 1.95 |
| II | 93/7 | 22.9 | 400 | 15 | MAA/AMPS 62.5/37.5 | 4.26 |
| III | 93/7 | 23.4 | 400 | 15 | MAA/AMPS 49/51 | 4.28 |
| IV | 93/7 | 21.9 | 530 | 20 | MAA/AMPS 49/51 | 4.28 |

TABLE 3-continued

Anionic Dispersion Polymers with AA/AMPS and MAA/AMPS Stabilizers.

| Polymer Description | | | | | | |
|---|---|---|---|---|---|---|
| | | | Formate | | Stabilizer | |
| | AcAm/AA (Wt. %) | RSV, dl/g | Level, ppm | Actives, % | Chemistry (Wt. %) | IV, dl/g |
| V | 70/30 | 30.1 | 800 | 15 | MAA/AMPS 15.3/84.7 | 4.25 |
| VI | 70/30 | 28.0 | 2800 | 25 | MAA/AMPS 15.3/84.7 | 2.5 |
| VII | 70/30 | 33.0 | 3100 | 25 | MAA/AMPS 15.3/84.7 | 4.2 |
| VIII | 70/30 | 20.0 | 4000 | 30 | MAA/AMPS 9.4/90.6 | 2.5 |
| IX | 70/30 | 23 | 3600 | 25 | MAA/AMPS 9.4/90.6 | 2.5 |
| X | 70/30 | 28.6 | 3300 | 25 | MAA/AMPS 15.3/84.7 | 2.5 |
| XI | 70/30 | 36 | 1200 | 15 | AMPS | 3.7 |

Preparation on Nonionic Dispersion Polymers

EXAMPLE 23

To a 1.5-liter resin reactor equipped with a stirrer, temperature controller and water cooled condenser is added 403.75 g of deionized water, 131.25 g of sodium sulfate, 87.5 g of ammonium sulfate, 64 g of a 15% solution of an 80/20 mole/mole acrylic acid/AMPS copolymer (IV=1.94 dl/gm), 481.72 g of a 48.6% solution of acrylamide (234.1 g), 0.60 g of sodium formate and 0.33 g of EDTA. The mixture is heated to 35° C. and 0.30 g of a 2% solution of VA-044 is added. The resulting solution is sparged with 1000 cc/min. of nitrogen. After 60 minutes, polymerization begins and the solution becomes viscous. After 2.75 hours, the mixture is a milky dough to which is added 0.30 g of a 2% solution of VA-044. After 3.75 hours, 0.30 g of a 2% solution of VA-044 is added. After 4.75 hours, the mixture is a milky dispersion and 1.2 g of a 2% solution of VA-044 is added. After 6.5 hours, 2.90 g of a 2% solution of VA-044 is added. The reaction is continued for a total of 24 hours at 34–36° C. At the end of the reaction the dispersion (4484-039) has a Brookfield viscosity of 2770 cps. To this dispersion is added 15 g of sodium sulfate and 10 g of ammonium sulfate. The resulting dispersion has a Brookfield viscosity of 487.5 cps and contains 20% of a homopolymer of acrylamide with an intrinsic viscosity of 15.26 dl/gm in 1.0 molar $NaNO_3$.

The properties of representative nonionic dispersion polymers are shown in Table 4. The polymers shown in Table 4 are prepared according to the method of Example 23.

TABLE 4

Nonionic Poly(acrylamide) Dispersion Polymers.

| Polymer | Actives % | Stabilizer Composition Mole/Mole | Visc. Cps. | IV |
|---|---|---|---|---|
| XII | 20 | 19/81 AMPS/Acrylic acid | 500 | 12.2 |
| XIII | 15 | 100% poly AMPS | 535 | 13.1 |
| XIV | 15 | 80/20 AMPS/Acrylic acid | 287.5 | 12.9 |
| XV | 15 | 34/66 AMPS/Acrylic acid | 160 | 14.2 |
| XVI | 15 | 19/81 AMPS/Acrylic acid | 140 | 13.5 |
| XVII | 15 | 9.3/90.7 AMPS/Acrylic acid | 270 | 13.8 |
| XVIII | 15 | 100% poly Acrylic acid | 563 | 15.5 |

TABLE 4-continued

Nonionic Poly(acrylamide) Dispersion Polymers.

| Polymer | Actives % | Stabilizer Composition Mole/Mole | Visc. Cps. | IV |
|---|---|---|---|---|
| XIX | 15 | 100% poly Methacrylic acid | 820* | 13.4 |
| XX | 15 | 90/10 Acrylic acid/acrylamide | 555* | 13.6 |
| XXI | 15 | 19/81 AMPS/Acrylic acid | 1645 | 13.4 |
| XXII | 15 | 100% poly Acrylic acid | 130 | 13.8 |

*These dispersions eventually gelled.

The Retention Test

The Retention Test uses a Britt CF Dynamic Drainage Jar developed by K. W. Britt of New York State University. The Britt Jar generally consists of an upper chamber of about 1 liter capacity and a bottom drainage chamber, the chamber being separated by a support screen and a drainage screen. Below the drainage chamber is a downward extending flexible tube equipped with a clamp for closure. The upper chamber is provided with a variable speed, high torque motor equipped with a 2-inch 3-bladed propeller to create controlled shear conditions in the upper chamber. The test is conducted by placing the cellulosic slurry in the upper chamber and then subjecting the slurry to the following sequences:

TABLE 5

Sequence for Evaluating Polymer Performance

| Time (seconds) | Action |
|---|---|
| 0 | Commence shear stirring at 750 rpm |
| 5 | Add Coagulant (when necessary) |
| 25 | Add Polymer |
| 35 | Start Draining |
| 65 | Stop draining; measure filtrate turbidity |

TABLE 6

Sequence for Evaluating Polymer Plus Microparticle Performance

| Time (seconds) | Action |
|---|---|
| 0 | Commence shear stirring at 750 rpm |
| 10 | Add Polymer |
| 20 | Add Microparticle |
| 30 | Start Draining |
| 60 | Stop draining; measure filtrate turbidity |

The material drained from the Britt jar (the "filtrate") is collected and diluted with water to one-fifth of its initial volume. The turbidity of such diluted filtrate, measured in Formazin Turbidity Units or FTU's, is then determined. The turbidity of such a filtrate is inversely proportional to the papermaking retention performance; the lower the turbidity value, the higher is the retention of filler and/or fines. The turbidity values are determined using a Hach Spectrophotometer, model DR2000.

The turbidity values (in FTU) that are determined are converted to (Percent Improvement) values using the formula:

$$\text{Percent Improvement}=100\times(\text{Turbidity}_u-\text{Turbidity}_t/\text{Turbidity}_u$$

where $\text{Turbidity}_u$ is the turbidity reading result for the blank for containing no polymer or microparticle, and wherein $\text{Turbidity}_t$ is the turbidity reading result of the test using polymer, or polymer and microparticle.

The cellulosic slurries used in the retention tests are as follows:

TEST SLURRY 1 is from a mid-western paper mill making acid fine paper. The solids in the slurry are made of about 90 weight percent chemical fibers (50/50 blend by weight of bleached hardwood kraft and bleached softwood kraft), about 2 weight percent broke (or recycled paper from the mill itself) and about 8 weight percent filler (titanium dioxide). Cationic starch is present at a level of 23 pounds per ton solids and alum at a level of about 25 pounds per ton solids. The overall consistency of the solids in the slurry is about 0.9 percent and the pH is roughly 4.8.

TEST SLURRY 2 is from a mid-western paper mill making alkaline fine paper. The solids in the slurry are made of about 70 weight percent chemical fibers (60/40 blend by weight of bleached hardwood kraft and bleached softwood kraft), about 25 weight percent broke (or recycled paper from the mill itself) and about 5 weight percent filler (a mixture of titanium dioxide and calcium carbonate). Cationic starch is present at a level of 24 pounds per ton solids. The overall consistency of the solids in the slurry is about 0.55 percent and the pH is roughly 8.0.

TEST SLURRY 3 comprises solids which are made up of about 80 weight percent fiber and about 20 weight percent filler, diluted to an overall consistency of 0.5 percent with formulation water. The fiber is a 60/40 blend by weight of bleached hardwood kraft (sulfate chemical pulp) and bleached softwood kraft (sulfate chemical pulp). To this slurry is added a mineral filler. The filler is a commercial calcium carbonate, provided in dry form. The formulation water contained 60 ppm calcium hardness (added as $CaCl_2$), 18 ppm magnesium hardness (added as $MgSO_4$) and 134 ppm bicarbonate alkalinity ( added as $NaHCO_3$). The pH of the final thin stock (cellulosic slurry plus filler and other additives equals a "stock") is between about 7.5 and about 8.0.

TEST SLURRY 4 is from a southern paper mill making acid fine paper. The solids in the slurry are made of about 90 weight percent chemical fibers (50/50 blend by weight of bleached hardwood kraft and bleached softwood kraft) and about 10 weight percent filler (a mixture of titanium dioxide and clay). Cationic starch is present at a level of about 4 pounds per ton solids and alum at a level of about 7 pounds per ton solids. The overall consistency of the solids in the slurry is about 0.5 percent and the pH is roughly 4.8.

Retention Data in Terms of Percent Improvement

Retention data for representative dispersion polymers according to this invention is shown in Tables 7–14. The data is presented in terms of percent improvement calculated as described herein. All polymer, coagulant and microparticle dosages are based on pounds per ton solids in the slurry.

TABLE 7

(Test Slurry 1, Polymers I and XXIII, No Additional Coagulant)

| Polymer Dosage | Polymer XXIII[a] | Polymer I |
|---|---|---|
| 0.06 | 15.6 | 27.0 |
| 0.12 | 24.7 | 37.8 |
| 0.19 | 29.9 | 42.0 |
| 0.30 | 40.0 | 48.0 |
| 0.60 | 55.0 | 60.5 |

TABLE 7-continued (Test Slurry 1, Polymers I and XXIII, No Additional Coagulant)

| Polymer Dosage | Polymer XXIII[a] | Polymer I |
|---|---|---|

[a]Polymer XXIII is an anionic latex copolymer comprising about 7 mole % sodium acrylate and about 93 mole % AcAm with a RSV of about 30 dl/g, available as Nalco ®623 from Nalco Chemical Company, Naperville, IL, USA.

TABLE 8

(Test Slurry 1, Polymers I, II, III and XXIII, No Additional Coagulant)

| Polymer Dosage | Polymer XXIII | Polymer I | Polymer III | Polymer II |
|---|---|---|---|---|
| 0.05 | 35.8 | 47.1 | 51.5 | 46.3 |
| 0.11 | 47.8 | 56.6 | 53.6 | 57.8 |
| 0.21 | 57.8 | 64.5 | 68.6 | 67.2 |

TABLE 9

(Test Slurry 2, Polymers I, V, XXIV and XXIII, No Additional Coagulant)

| Polymer Dosage | Polymer XXIV[a] | Polymer V | Polymer XXIII | Polymer I |
|---|---|---|---|---|
| 0.05 | 37.8 | 37.6 | 36.1 | 48.3 |
| 0.10 | 56.2 | 54.4 | 52.9 | 59.2 |
| 0.19 | 70.7 | 69.4 | 67.6 | 70.2 |
| 0.29 | 78.9 | 78.1 | 75.5 | 76.3 |

[a]Polymer XXIV is an anionic laxtex copolymer comprising about 30 mole % sodium acrylate and about 70 mole % AcAm with a RSV of about 30 dl/g, available as Nalco ®625 from Nalco Chemical Company, Naperville, IL, USA.

TABLE 10

(Test Slurry 4, Polymers III, IV and XXIII, Coagulant A[a] present at a dosage of 10 lb/ton-solids-in-slurry)

| Polymer Dosage | Polymer XXIII | Polymer III | Polymer IV |
|---|---|---|---|
| 0.2 | 32.6 | 42.6 | 38.8 |
| 0.4 | 35.7 | 52.8 | 47.3 |
| 0.8 | 53.8 | 72.6 | 63.3 |

[a]Coagulant A is a cationic potato starch, which is commercially available as Solvitose N ™, from Nalco Chemical Company, Naperville, IL, USA.

TABLE 11

(Test Slurry 3, Polymers III and XXIII, Coagulant A present at a dosage of 10 lb/ton-solids-in-slurry; Coagulant B[a] present at a dosage of 0.5 lb/ton-solids-in-slurry)

| Polymer Dosage | Polymer XXIII | Polymer III |
|---|---|---|
| 0.25 | 58.0 | 61.7 |
| 0.50 | 64.5 | 70.4 |
| 1.00 | 71.3 | 76.6 |

[a]Coagulant B is a solution polymer of epichlorohydrin-dimethylamine; available as Nalco ® 7607 from Nalco Chemical Company, Naperville, IL, USA.

TABLE 12

(Test Slurry 3, Polymers VI, VII and XXIV, Coagulant A present at a dosage of 10 lb/ton-solids-in-slurry; Coagulant B present at a dosage of 0.5 lb/ton-solids-in-slurry)

| Polymer Dosage | Polymer XXIV | Polymer VI | Polymer VII |
|---|---|---|---|
| 0.25 | 63.36 | 68.1 | 65.9 |
| 0.50 | 69.97 | 81.9 | 76.8 |
| 1.00 | 82.09 | 88.1 | 85.4 |
| 1.50 | 88.71 | 91.6 | 90.5 |

TABLE 13

(Test Slurry 1, Polymers I and XXIII, (Dosage of 1.1 lb/ton-solids-in-slurry) with Microparticles, No Additional Coagulant)

| | Polymer XXIII | | Polymer I | |
|---|---|---|---|---|
| Microparticle Dosage | Micro-particle Red[a] | Microparticle Blue[b] | Micro-particle Red | Microparticle Blue |
| 1.10 | 43.5 | | 42.1 | |
| 2.20 | 42.9 | | 49.7 | |
| 4.45 | | 42.7 | | 44.3 |
| 8.90 | | 53.4 | | 51.5 |

[a]Microparticle Red is a naphthalene sulfonate/formaldehyde condensate polymer in water available as Nalco ® 8678 from Nalco Chemical Company.
[b]Microparticle Blue is a borosilicate in water; which is available as Nalco ® 8692 from Nalco Chemical Company.

TABLE 14

(Test Slurry 3, Polymers VIII and IX (Dosage of 0.5 lb/ton-solids-in-slurry) with Microparticle Blue, Coagulant A present at a dosage of 10 lb/ton-solids-in-slurry; Coagulant B present at a dosage of 0.5 lb/ton-solids-in-slurry)

| | Microparticle | | |
|---|---|---|---|
| Polymer Type | Type | Dose | Improvement |
| VIII | None | — | 55.9 |
| VIII | Blue | 1.0 | 65.4 |
| VIII | Blue | 2.0 | 65.9 |
| IX | None | — | 58.3 |
| IX | Blue | 1.0 | 66.5 |

TABLE 15

(Test Slurry 3; Polymer XII; Coagulant A present at a dosage of 10 lb/ton-solids-in-slurry; Coagulant B present at a dosage of 0.5 lb/ton-solids-in-slurry)

| Polymer Dosage | Polymer XII |
|---|---|
| 0.50 | 54.5 |
| 1.00 | 62.4 |
| 1.50 | 65.7 |
| 2.00 | 66.5 |

The data presented in Tables 7–15 demonstrate that the dispersion polymers described herein are effective retention aids in a papermaking process. Furthermore, the anionic dispersion polymers described herein are unexpectedly more effective at improving retention in a papermaking process than the corresponding latex polymer. This improvement is also observed when the dispersion polymers are used together with microparticle retention aids.

What is claimed is:

1. A method of increasing retention and drainage in a papermaking furnish comprising adding to the furnish from about 0.02 lbs polymer/ton to about 20 lbs polymer/ton of a high molecular weight water-soluble dispersion polymer wherein the dispersion polymer has a bulk Brookfield viscosity of from about 10 to about 25,000 cps at 25° C. and comprises from about 5 to about 50 weight percent of a water-soluble polymer prepared by polymerizing under free radical forming conditions at a pH of from above 5 to about 8 in an aqueous solution of a water-soluble salt in the presence of a stabilizer:

i. 0 to about 30 mole percent of acrylic acid or methacrylic acid or the alkali metal, alkaline earth metal or ammonium salts thereof, and, ii. 100 to about 70 mole percent of acrylamide;

wherein the stabilizer is an anionic water-soluble copolymer of acrylic acid or methacrylic acid and 2-acrylamido-2-methyl-1-propanesulfonic acid having an intrinsic viscosity in 1M $NaNO_3$ of from about 0.1–10 dl/g and comprises from about 0.1 to about 5 weight percent based on the total weight of the dispersion, and the water-soluble salt is selected from the group consisting of ammonium, alkali metal and alkaline earth metal halides, sulfates, and phosphates and comprises from about 5 to about 40 weight percent based on the weight of the dispersion.

2. The method of claim 1 wherein the stabilizer has a concentration from about 0.25 to about 2 weight percent based on the weight of the total dispersion and an intrinsic viscosity in 1M $NaNO_3$ of from about 0.5–7.0 dl/g.

3. The method of claim 2 wherein the water-soluble polymer is poly (acrylic acid/acrylamide) comprising from about 7 to about 30 weight percent acrylic acid and from about 93 to about 70 weight percent acrylamide.

4. The method of claim 3 wherein the water-soluble polymer is poly (acrylic acid/acrylamide) having a weight ratio of 7:93 for acrylic acid to acrylamide and the stabilizer is poly (2-acrylamido-2-methyl-1-propanesulfonic acid/acrylic acid) having a weight ratio of 13:87 2-acrylamido-2-methyl-1-propanesulfonic acid: acrylic acid.

5. The method of claim 3 wherein the water-soluble polymer is poly (acrylic acid/acrylamide) having a weight ratio of 7:93 for acrylic acid to acrylamide and the stabilizer is poly (2-acrylamido-2-methyl-1-propanesulfonic acid/methacrylic acid) having a weight ratio of 37.5:62.5 2-acrylamido-2-methyl-1-propanesulfonic acid: methacrylic acid.

6. The method of claim 3 wherein the water-soluble polymer is poly (acrylic acid/acrylamide) having a weight ratio of 7:93 for acrylic acid to acrylamide and the stabilizer is poly (2-acrylamido-2-methyl-1-propanesulfonic acid/methacrylic acid) having a weight ratio of 51:49 2-acrylamido-2-methyl-1-propanesulfonic acid: methacrylic acid.

7. The method of claim 3 wherein the water-soluble polymer is poly (acrylic acid/acrylamide) having a weight ratio of 30:70 for acrylic acid to acrylamide and the stabilizer is poly (2-acrylamido-2-methyl-1-propanesulfonic acid/methacrylic acid) having a weight ratio of 84.7:15.3 2-acrylamido-2-methyl-1-propanesulfonic acid: methacrylic acid.

8. The method of claim 3 wherein the water-soluble polymer is poly (acrylic acid/acrylamide) having a weight ratio of 30:70 for acrylic acid to acrylamide and the stabilizer is poly (2-acrylamido-2-methyl-1-propanesulfonic acid/methacrylic acid) having a weight ratio of 90.6:9.4 2-acrylamido-2-methyl-1-propanesulfonic acid: methacrylic acid.

9. The method of claim 1 wherein from about 1 lbs polymer/ton to about 15 lbs polymer/ton of the high molecular weight water-soluble dispersion polymer is added to the furnish.

10. The method of claim 1 further comprising adding a microparticle to the furnish.

11. The method of claim 10 wherein the microparticle is selected from copolymers of acrylic acid and acrylamide; bentonites; naphthalene sulfonate/formaldehyde condensate polymers and dispersed silicas.

12. The method of claim 1 further comprising adding a coagulant to the furnish prior to addition of the high molecular weight water-soluble dispersion polymer.

13. The method of claim 12 wherein the coagulant is a water-soluble cationic polymer.

14. The method of claim 13 wherein the water-soluble cationic polymer is epichlorohydrin-dimethylamine or polydiallyldimethylammonium chloride.

15. The method of claim 13 wherein the coagulant is selected from alum or polyaluminum chlorides.

16. The method of claim 13 wherein the coagulant is a cationic starch.

* * * * *

UNITED STATES PATENT AND TRADEMARK OFFICE

CERTIFICATE OF CORRECTION

PATENT NO. : 6,331,229 B1 
DATED : December 18, 2001
INVENTOR(S) : Jane B. Wong Shing, Chidambaram Maltesh and John R. Hurlock It is certified that error appears in the above-identified patent and that said Letters Patent is hereby corrected as shown below:

Title page,
The title should read as:

-- METHOD OF INCREASING RETENTION AND DRAINAGE IN PAPERMAKING USING HIGH MOLECULAR WEIGHT WATER-SOLUBLE ANIONIC OR NONIONIC DISPERSION POLYMERS --

Signed and Sealed this

Fourteenth Day of May, 2002

*Attest:*

*Attesting Officer*

JAMES E. ROGAN
*Director of the United States Patent and Trademark Office*